US008415280B2

(12) United States Patent
Sloan

(10) Patent No.: US 8,415,280 B2
(45) **Date of Patent: *Apr. 9, 2013**

(54) UNIVERSAL SYNTHETIC PENETRATING LUBRICANT, METHOD AND PRODUCT-BY-PROCESS

(75) Inventor: Ronald J. Sloan, Blaine, WA (US)

(73) Assignee: BestLine International Research, Inc., Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/309,648

(22) Filed: Dec. 2, 2011

(65) Prior Publication Data

US 2012/0077720 A1 Mar. 29, 2012

Related U.S. Application Data

(63) Continuation of application No. 12/747,236, filed as application No. PCT/US2008/087433 on Dec. 18, 2008, now Pat. No. 8,071,513, and a continuation-in-part of application No. 11/290,596, filed on Dec. 1, 2005, now Pat. No. 7,745,382, and a continuation of application No. 12/060,637, filed on Apr. 1, 2008, now Pat. No. 8,022,020, and a continuation-in-part of application No. PCT/US2007/088252, filed on Dec. 19, 2007, now Pat. No. 8,062,388, and a continuation-in-part of application No. PCT/US2008/050951, filed on Jan. 13, 2008, now Pat. No. 8,071, 522.

(60) Provisional application No. 60/644,494, filed on Jan. 18, 2005.

(51) Int. Cl.
*C10M 169/04* (2006.01)

(52) U.S. Cl.
USPC ..... 508/110; 508/181; 508/390; 508/577; 508/591

(58) Field of Classification Search ..... 508/110, 508/181, 390, 577, 591
See application file for complete search history.

(56) References Cited

U.S. PATENT DOCUMENTS

| | | | |
|---|---|---|---|
| 3,406,419 | A | 10/1968 | Young |
| 3,984,599 | A | 10/1976 | Norton |
| 4,127,491 | A | 11/1978 | Reick |
| 4,131,551 | A | 12/1978 | Thompson et al. |
| 4,218,330 | A | 8/1980 | Shubkin |
| 4,224,173 | A | 9/1980 | Reick |
| 4,228,021 | A | 10/1980 | Lenack |
| 4,375,418 | A | 3/1983 | Zoleski et al. |
| 4,443,348 | A | 4/1984 | Wright et al. |
| 4,504,404 | A | 3/1985 | Schumacher et al. |
| 4,534,873 | A | 8/1985 | Clark |
| 4,844,825 | A | 7/1989 | Sloan |
| 4,859,359 | A | 8/1989 | DeMatteo et al. |
| 4,956,122 | A | 9/1990 | Watts et al. |
| 5,120,358 | A | 6/1992 | Pippett |
| 5,136,118 | A | 8/1992 | Buchanan et al. |
| 5,202,040 | A | 4/1993 | Sanderson et al. |
| 5,332,516 | A | 7/1994 | Stephens |
| 5,364,994 | A | 11/1994 | Scharf |
| 5,431,841 | A | 7/1995 | Lockhart |
| 5,631,211 | A | 5/1997 | Nakagawa et al. |
| 5,672,572 | A | 9/1997 | Araik et al. |
| 5,681,797 | A | 10/1997 | Lawate |
| 5,741,764 | A | 4/1998 | Patel et al. |
| 5,885,942 | A | 3/1999 | Zhang et al. |
| 5,972,853 | A | 10/1999 | Boffa et al. |
| 6,008,164 | A | 12/1999 | Aldrich et al. |
| 6,046,142 | A | 4/2000 | Zilonis et al. |
| 6,074,993 | A | 6/2000 | Waddoups et al. |
| 6,143,701 | A | 11/2000 | Boffa |
| 6,413,916 | B1 | 7/2002 | Baumgart et al. |
| 6,761,645 | B1 | 7/2004 | Weber |
| 6,774,091 | B2 | 8/2004 | Dituro et al. |
| 6,858,567 | B2 | 2/2005 | Akao |
| 6,919,300 | B2 | 7/2005 | Dituro |
| 6,962,895 | B2 | 11/2005 | Scharf et al. |
| 6,992,049 | B2 | 1/2006 | Deckman et al. |
| 7,018,960 | B2 | 3/2006 | Negoro et al. |
| 7,022,766 | B2 | 4/2006 | Okada et al. |
| 7,055,534 | B2 | 6/2006 | Goode et al. |
| 7,109,152 | B1 | 9/2006 | Corby et al. |
| 7,124,728 | B2 | 10/2006 | Carey et al. |

(Continued)

FOREIGN PATENT DOCUMENTS

| | | | |
|---|---|---|---|
| DE | 19723460 | A1 | 1/1998 |
| EP | 0361180 | A1 | 4/1990 |

(Continued)

OTHER PUBLICATIONS

Rudnick, Leslie R., Ed., Synthetic Mineral Oils and Bio Based Lubricants: Chemistry and Technology, Taylor & Francis (2006).

(Continued)

*Primary Examiner* — Cephia D Toomer
(74) *Attorney, Agent, or Firm* — Jay R. Yablon

(57) ABSTRACT

A penetrating lubricant with the capacity to offer a both penetration into rust and corrosion. Further, this lubricant actively penetrates the crystalline surface of the metal while exhibiting extreme pressure lubrication, non-migrating with lasting protection. Further lubricant exhibits dielectric strength of over 8000 volts, at the same time cleaning electrical contacts, thereby reducing resistance and associated heat. The preferred embodiment may contain alpha-olefins, low-odor aromatic solvents, base oils, and high flash mineral spirits.

10 Claims, No Drawings

U.S. PATENT DOCUMENTS

| | | | | |
|---|---|---|---|---|
| 7,745,382 | B2 | 6/2010 | Sloan | |
| 7,931,704 | B2 | 4/2011 | Sloan | |
| 8,022,020 | B2 * | 9/2011 | Sloan | 508/110 |
| 8,039,424 | B2 | 10/2011 | Sloan | |
| 8,062,388 | B2 | 11/2011 | Sloan | |
| 8,071,513 | B2 * | 12/2011 | Sloan | 508/110 |
| 8,071,522 | B2 | 12/2011 | Sloan | |
| 2003/0040444 | A1 | 2/2003 | Garmier | |
| 2003/0087769 | A1 | 5/2003 | Dituro et al. | |
| 2004/0014613 | A1 | 1/2004 | Dituro et al. | |
| 2004/0060229 | A1 | 4/2004 | Todd et al. | |
| 2004/0077506 | A1 | 4/2004 | Arrowsmith et al. | |
| 2006/0160708 | A1 | 7/2006 | Sloan | |
| 2008/0182769 | A1 | 7/2008 | Sloan | |
| 2008/0190014 | A1 | 8/2008 | Volkel et al. | |
| 2010/0269404 | A1 | 10/2010 | Sloan | |
| 2010/0273687 | A1 | 10/2010 | Sloan | |
| 2010/0273688 | A1 | 10/2010 | Sloan | |
| 2011/0009301 | A1 | 1/2011 | Sloan | |
| 2011/0015103 | A1 | 1/2011 | Sloan | |
| 2011/0197499 | A1 | 8/2011 | Sloan | |

FOREIGN PATENT DOCUMENTS

| | | | |
|---|---|---|---|
| EP | 0837122 | A2 | 4/1998 |
| EP | 1203803 | A1 | 5/2002 |
| EP | 1736529 | A1 | 12/2006 |
| FR | 2193080 | | 7/1972 |
| JP | 59204700 | | 11/1984 |
| JP | 07233001 | | 9/1995 |
| JP | 2001-271077 | A | 10/2001 |
| WO | 9719153 | | 5/1997 |
| WO | 0234867 | A1 | 5/2002 |
| WO | 03064571 | A1 | 8/2003 |
| WO | 2006-015800 | A1 | 2/2006 |
| WO | 2006100188 | A1 | 9/2006 |
| WO | 2007004789 | A1 | 1/2007 |
| WO | 2009078882 | A1 | 6/2009 |
| WO | 2009079020 | A1 | 6/2009 |
| WO | 2009085957 | A1 | 7/2009 |
| WO | 2009085967 | A1 | 7/2009 |

OTHER PUBLICATIONS

Journal of Automotive Engineering, May 1, 2001, vol. 55, No. 5, pp. 67-72.

Journal of Automotive Engineering, May 1, 2001, vol. 55, No. 5, pp. 67-72, English translation of: page 70, last paragraph; Figures 6 and 7.

Kioupis, L.I. ; Maginn, E.J., Molecular simulation of poly-{alpha}-olefin synthetic lubricants: Impact of molecular architecture on performance properties, Journal of Physical Chemistry B: Materials, Surfaces, Interfaces, amp Biophysical; Journal vol. 103; Journal Issue: 49; Dec. 9, 1999.

* cited by examiner

UNIVERSAL SYNTHETIC PENETRATING LUBRICANT, METHOD AND PRODUCT-BY-PROCESS

CROSS-REFERENCE TO RELATED APPLICATIONS

This application is a continuation of application U.S. Ser. No. 12/747,236 filed Jun. 10, 2010, now U.S. Pat. No. 8,071,513 issued Dec. 6, 2011. Said U.S. Ser. No. 12/747,236 is a US national stage of application PCT/US08/87433 filed Dec. 18, 2008; and is also a continuation in part of application U.S. Ser. No. 11/290,596 filed Dec. 1, 2005, now U.S. Pat. No. 7,745,382 issued Jun. 29, 2010; and is also a continuation of U.S. Ser. No. 12/060,637 filed Apr. 1, 2008, now U.S. Pat. No. 8,022,020 issued Sep. 20, 2011; and is also a continuation in part of application PCT/US07/88252 filed Dec. 19, 2007; and is also a continuation in part of application PCT/US08/50951 filed Jan. 13, 2008. Said U.S. Ser. No. 11/290,596 claims benefit of expired provisional application 60/644,494 filed Jan. 18, 2005. This application also claims foreign priority benefit of: PCT/US07/88252 filed Dec. 19, 2007 and PCT/US08/50951 filed Jan. 13, 2008.

FIELD OF THE INVENTION

This invention relates to a synthetic penetrating lubricant capable of dissolving rust and corrosion caused by oxidation and harsh chemicals while offering extreme pressure lubrication capacities with a high dielectric protection.

BACKGROUND OF THE INVENTION

Over the years many penetrating compounds have been developed to penetrate rust and corrosion, but they exhibit few if any lubrication qualities. Further many topical lubricants have been developed for lubrication, but again exhibit little if any penetrating capacity. Of the many products developed, few have demonstrated extreme pressure capability. Further, there are several industrial products offering the benefit of dielectric strength. Those tested found to be far short of their claims. Further there are a number of products developed to clean electrical contacts to reduce resistance and associated heat. Again these products sorely lack the ability to lubricate or penetrate rust and oxidation.

SUMMARY OF THE INVENTION

Disclosed herein is a penetrating lubricant with the capacity to penetrate rust and corrosion caused by oxidation or harsh chemicals, into the crystalline surface of the metal, leaving a non-migrating lasting lubricant with extreme pressure capabilities. Further the product offers the ability to clean electrical contacts for improved conductivity while offering insulation and isolation by way of an extremely high dielectric strength. Further the product when applied to ferrous and non-ferrous material, is resistant the environment including salt waters. This penetrating lubricant comprises alpha-olefins; low-odor aromatic solvents; and at least one a base oil selected from the base oil group consisting of hydroisomerized high base oils and HT Severe Hydro-cracked Base Oils; as well as other ingredients. Also disclosed is a method for producing this penetrating lubricant.

Specifically, disclosed is universal synthetic penetrating lubricant for penetrating and dissolving rust and corrosion and cleaning metal and removing oxidation, while providing lubrication including extreme pressure lubrication, high dielectric protection, and corrosion resistance, comprising: alpha-olefins; low-odor aromatic solvents; at least one base oil selected from the base oil group consisting of hydroisomerized high-base oils and HT severe hydro-cracked base oils; and high flash mineral spirits.

DETAILED DESCRIPTION

The invention relates to the use of a multi-functional penetrating lubricant with applications as a general penetrating liquid for dissolving and loosening of corrosion and rust caused by oxidation or harsh chemicals. The invention further has the ability to penetrate into the crystalline surface of metal, leaving a lubricating film that is resistant to future corrosion. Further the invention leaves a barrier film that has extreme pressure capacity. Further the invention acts as a solvent to remove oxidation between electrical contacts to allow maximum flow of electricity while reducing resistance and heat associated with resistance. Although the invention cleans contacts for reduced resistance, it also isolates and insulates electrical contacts to protect them from moisture and other such elements which can cause electrical shorts and failure. The invention demonstrates high dielectric strength while exhibiting the characteristics of a penetrant, lubricant, extreme pressure lubricant, and contact cleaner.

Primary Ingredients

The preferred embodiment of the invention is a combination of:

- Alpha-Olefins: This is a primary ingredient which is a derivative of linear alpha-olefins incorporating 1-decene to distinguish it from other mono-olefins by way of polymerization and hydrogenation. These are also known as Alkenes, Polymerized Chlorowax Liquids, and Chlorinated Paraffins whose carbon chain length are C12, C14, C12-24, C16-18, C24-30 and C20-30 with said choleric weight percentage from 21.4% to 70%, an HCI of 4 to 10 ppm and molecular weight of 273.5 to 650 and Wt. Cl (2) from 20 to 70% with specific gravity at 25 degrees centigrade of 1.050 to 1.50 and a JQD weight percentage of HCL being 0.20 to 0.60 maximum. The primary use is for this ingredient is for lubricant formulations, lubricant additive compounds, extreme-pressure additive formulations and for metal working compounds. Further, alpha-olefins or associated products reduce the growth of algae in fuel as aging or excessive moisture accumulates and stabilize the fuel over time while providing extreme lubrication to the fuel system and the firing chamber of the engine.
- Low-odor Aromatic Solvents: This is a primary ingredient which is a highly-refined, low toxic, low-odor solvent ideal for paints, varnishes, food grade coatings, adhesives, diluents, thinners, agrochemicals, household pesticides, a thinner for spray oils/lubricants and specialty chemicals. Aromatic percentage is 5 to 40% (EC-A-G04), a flash point of 20 to 80 degrees centigrade (ASTM D-93) and a density at 30 degrees centigrade (plus/minus) 0.600 to 0.900 (ASTM D-4052).
- Hydroisomerized High-Base Oils or HT Severe Hydro-cracked Base Oils: This primary ingredient is a severe hydro-cracked or hydroisomerized base oil with low or no aromatics and impurities achieved by chemically reacting the feed stock with hydrogen (3000 P.S.I.) to reduce or remove polar compounds containing sulphur, nitrogen and oxygen and to convert aromatic hydrocarbons to saturated cyclic hydrocarbons breaking up the heavy polycyclo-paraffin molecules to light saturated hydrocarbons. This may include fractionated oils that have been hydro-finished or hydro-polished. The base oils can be used in a host of lubricating oils, motor oils, cutting oils, food processing, pharmaceutical, industry, agriculture lubricants and extreme pressure additives. These add to the lubrication of ultra low sulfur diesel fuel.

High Flash Mineral Spirits: A colorless homogeneous solution with an evaporation rate of 0.11 (n-butyl acetate) and referred to as petroleum distillates that has been synthesized from selected hydrocarbons. This is often referred to as Stoddard Solvent #3 and/or Mineral Spirits, and is commonly used as an cleaning solvent, solvent in aerosols, paints, lacquers, varnishes and paint thinners for household and commercial use and has been subjected to hydrodesulfurization solvent extraction with a mixture of saturated aliphatic and alicyclic C7-C12 with a maximum of 40%. The flash point ranges from 40 to 55 degrees centigrade, aniline point of 60 to 85 degrees centigrade and a vapor density of 0.758 (kg/L) at 15 degrees centigrade. This component assists in dissolving oxidation and is necessary when pressurizing the finished product in aerosol containers.

Other Ingredients

Synthetic Calcium Sulfonates: An over based calcium sulfonate with a TBN of 100 to 600, which may be prepared from C20-C24 linear monoalkyl phenylsufonic acid, and whose primary purpose is for extreme pressure additive formulations offering corrosion protection, dispersants and detergency in oil soluble additives for ferrous and no-ferrous metals with a minimum calcium weight of 10.00 to 20.00%, a total base number, mg KOH/g (ASTM D-2896) of 100 to 600 and an average molecular weight (ASTM D-3712) of 800 to 1200.

Methyl-Isobutyl Ketones (MIBK): Formula (6H12) CAS 108-10-1, Flammable Liquid. MIBK is general used a as solvent for vinyl, epoxy, acrylic and natural resins, nitrocellulose, paints, varnishes, lacquers, protective coatings, rare metal extractions and dyes. Further it is commonly used in manufacturing antibiotics, dry-cleaning preparations and the synthesis of methyl isobutyl carbinol. It occurs naturally in oranges, grapes and vinegar. It is colorless, has low boiling point, and is miscible in proportions with water, alcohols, most hydrocarbons and other organic liquids. MIBK has a flash point of 14 degrees centigrade. MIBK is manufactured from acetones via a three-step process involving dimerised alcohol condensation to diacetone alcohol. Further diacetone readily hydrates to give mesityl oxides. Mesityl oxides can then be hydrogenated to MIBK. MIBK is used as a denaturing agent for denatured alcohols and as such lends itself a quick drying agent.

Solvent activated dyes: An alcohol (NAHA) solution of polymer color forming compounds. These are commonly used to identify grades or designated uses of fuels and lubricants. They are produced in both powder and liquid form and when introduced to the product are stable and leave an identifiable color to the product.

Solvent-Activated Fragrance: Alcohol-concentrated fragrance essence with an HA or NAHA of 0.005% to 1%. The active ingredient resists bacterial growth and contains a molecular encapulant (fixative) to maintain the selective fragrance uses to mask the chemical odor of certain compounds.

Polytetrafluoroethylene (fluoroadditive): CAS No 9002-84-0. Fluoroadditives are organic polymers in colloidal form that when blended into a solvent base compound and applied are highly-resistant to water or weathering conditions.

Preferred Blending Ratios

The preferred blending ratios for each component are shown as below. It is important to maintain a blend of components that fall within the following percentages. Note that in the event one or more of the ingredients shown below is omitted from the penetrating lubricant, the percentages by weight of the remaining ingredients are proportionately increased:

Alpha-Olefins: 2 to 30% by weight and preferably 7.0 to 25% by weight and more preferably 9.0 to 22% by weight. Most preferable is 17.0% by weight.

Low-odor Aromatic Solvents: 2 to 25% by weight and preferably 4.5 to 18% by weight and more preferably 7 to 14% by weight. Most preferable is 9.4% by weight.

Hydroisomerized High-Base Oils and HT Severe Hydrocracked Base Oils: 7 to 55% by weight and preferably 10 to 42% by weight and more preferably 15 to 35% by weight. Most preferable is 31.5% by weight.

High Flash Mineral Spirits: 15 to 60% by weight and preferably 20 to 55% by weight and more preferably 25 to 49% by weight. Most preferable is 34.6% by weight.

Synthetic Calcium Sulfonates: 0.05 to 1.05% by weight, preferably 0.25 to 0.95% by weight and more preferably 0.56 to 0.87% by weight. Most preferable is 0.833% by weight.

Methyl-Isobutyl Ketones: 2.0 to 25% by weight and preferably 4 to 16% by weight and more preferably 5 to 11% by weight. Most preferable is 7.2%.

Solvent Activated Dyes: 0.002 to 0.005% by weight and preferably 0.0025 to 0.004% by weight and more preferably 0.027 to 0.035% by weight. Most preferable is 0.003% by weight.

Solvent Activated Fragrances: 0.001 to 0.005% by weight and preferably 0.0015 to 0.004 and more preferably 0.00175 to 0.003% by weight. Most preferable is 0.002% by weight.

Polytetrafluoroethylene (fluoroadditive): 0.012 to 0.097% by weight and preferably 0.022 to 0.0925% and more preferably 0.042 to 0.085% by weight. Most preferable is 0.0835% by weight.

Preferred Sequence of Blending Components

The initial blend (primary blend) will require the alpha olefins, the low-odor aromatic solvent and the base oils being blended until the liquid is a consistent amalgamation without any appearance of separation. Blending is based on speed of the agitator and temperature will dictate the amount of time for the blend to complete. The blending time range may vary from 4 to 6 hours. The ideal temperature for each component is between 22 to 30 degrees centigrade for ideal blending.

While this is blending, a secondary blend for the methyl isobutyl ketones, solvent activated dyes and solvent activated fragrance is prepared in a much smaller high-speed enclosed blender, and then added to the main blend.

The synthetic calcium sulfonates will be blended with the mineral spirits in an approximate 0.25/75 ratio in the initial stage of the blend to produce a tertiary blend. (The mineral spirits used will be from the preferred percentage set forth earlier.) This tertiary blend, or the mineral spirits alone absent the synthetic calcium sulfonates, together with the balance of the ingredients, can be then added to the main blend and the agitator is run until the components appear to have thoroughly blended into a consistent liquid.

Preferred Blend Equipment

The process sequence involves a series of blending and holding tanks where the product can be weighed and then pumped through control valves to maintain consistent flow and pressure. The blending should be performed in an enclosed tank to reduce product evaporation (loss) and prevent exposure to open spark. Blending equipment can be by a combination of high or low speed blending apparatus. Size or volume of tank is not critical to the blend.

Universal Use of Invention

The product has been industrially tested, on an experimental basis, in extreme and harsh conditions. The invention has been so-tested in various forms of machining, and in electrical applications where elements such as water are a constant source of shorting and electrical safety and failure are a concern. The invention has been tested as an extreme pressure topical lubricant and has exceeded the performance of most lubricants available. Finally the product has been severely tested, experimentally, in applications with extreme rust and corrosion and has demonstrated the ability to penetrate and loosen the same while leaving a protective barrier on the metal. The product has shown its ability to work well with ferrous and non-ferrous material with profound results including the protection of brake rotors.

Testing Procedures

As the product is unique in its field and as such has been tested on the Timken Bench Tester and has demonstrated the capacity to exceed the lubrication capacity of an engine lubricant many time over. When tested the average engine lubricant failed at 5 to 7 foot-pounds. The average penetrant failed at less than 2 foot-pounds while the invention exceeded 30 foot-pounds of destructive weight. Further when tested for dielectric strength, the invention exhibited the capacity of over 8000 volts protection. When the invention was tested in machine, tapping and drilling, the invention allowed the tool to leave a highly refined finish on the points of contact and pressure.

Test Results

As there is no particular ASTM-D test protocol to measure the ability of a multi-purpose penetrating lubricant, the inventor has had to rely on actual results from hands on use of the products in various fields of testing.

This experimental testing has demonstrated the ability of the invention to show dramatic improvement in all the fields of testing, to such a degree that there may be potential to exhibit positive results in application areas yet to be considered.

While only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

I claim:

1. A method for producing a synthetic penetrating lubricant, comprising:

blending alpha-olefins, low-odor aromatic solvents, and at least one base oil selected from the base oil group consisting of hydroisomerized high-base oils and HT severe hydro-cracked base oils until the blend is a consistent amalgamation without any appearance of separation, thereby producing a primary blend; and adding high flash mineral spirits to said primary blend.

2. The method of claim 1, further comprising:

separately blending said high flash mineral spirits and calcium sulfonates, thereby producing a tertiary blend; and adding said tertiary blend to said primary blend.

3. The method of claim 1, further comprising:

separately blending methyl isobutyl ketones, solvent-activated dyes, and solvent-activated fragrance, thereby producing a secondary blend; and adding said secondary blend and said mineral spirits to said primary blend.

4. The method of claim 2, further comprising:

separately blending methyl isobutyl ketones, solvent-activated dyes, and solvent-activated fragrance, thereby producing a secondary blend; and adding said secondary and tertiary blends to said primary blend.

5. The method of claim 4, further comprising:

adding said secondary and tertiary blends and at least one fluoroadditive, to said primary blend.

6. A synthetic penetrating lubricant product-by-process, produced by a method comprising:

blending alpha-olefins, low-odor aromatic solvents, and at least one base oil selected from the base oil group consisting of hydroisomerized high-base oils and HT severe hydro-cracked base oils until the blend is a consistent amalgamation without any appearance of separation, thereby producing a primary blend; and adding high flash mineral spirits to said primary blend.

7. The product-by-process of claim 6, said method further comprising:

separately blending said mineral spirits and calcium sulfonates, thereby producing a tertiary blend; and adding said tertiary blend to said primary blend.

8. The product-by-process of claim 6, said method further comprising:

separately blending methyl-isobutyl ketones, solvent-activated dyes, and solvent-activated fragrance, thereby producing a secondary blend; and adding said secondary blend and said mineral spirits to said primary blend.

9. The product-by-process of claim 7, said method further comprising:

separately blending methyl-isobutyl ketones, solvent-activated dyes, and solvent-activated fragrance, thereby producing a secondary blend; and adding said secondary and tertiary blends to said primary blend.

10. The product-by-process of claim 9, said method further comprising:

adding said secondary and tertiary blends and at least one fluoroadditive, to said primary blend.

* * * * *